US007934704B2

(12) United States Patent
Tharp

(10) Patent No.: US 7,934,704 B2
(45) Date of Patent: May 3, 2011

(54) RETRIEVABLE DIFFUSER MODULE WITH INTERNAL BALLAST/BUOYANCY CHAMBER

(75) Inventor: Charles E. Tharp, Columbia, MO (US)

(73) Assignee: Environmental Dynamics, Inc., Columbia, MO (US)

( * ) Notice: Subject to any disclaimer, the term of this patent is extended or adjusted under 35 U.S.C. 154(b) by 867 days.

(21) Appl. No.: 11/873,271

(22) Filed: Oct. 16, 2007

(65) Prior Publication Data

US 2009/0095692 A1 Apr. 16, 2009

(51) Int. Cl.
*B01F 3/04* (2006.01)

(52) U.S. Cl. ..... 261/23.1; 261/120; 261/122.1; 210/242.2

(58) Field of Classification Search ..... 261/23.1, 261/64.1, 65, 66, 120, 122.1, 122.2; 210/242.2
See application file for complete search history.

(56) References Cited

U.S. PATENT DOCUMENTS

| | | | | |
|---|---|---|---|---|
| 2,650,810 | A | 9/1953 | Nordell | |
| 2,989,186 | A | 6/1961 | Weis | |
| 3,033,372 | A * | 5/1962 | Riddick | 210/220 |
| 3,160,685 | A | 12/1964 | Chase | |
| 3,174,733 | A | 3/1965 | Chase | |
| 4,215,082 | A * | 7/1980 | Danel | 261/124 |
| 4,273,732 | A | 6/1981 | Roediger | |
| 4,287,060 | A * | 9/1981 | Coggins | 210/194 |
| 4,563,277 | A | 1/1986 | Tharp | |
| 4,797,212 | A | 1/1989 | von Nordenskjold | |
| 5,059,358 | A | 10/1991 | Tharp | |
| 5,089,179 | A * | 2/1992 | von Nordenskjold | 261/81 |
| 5,118,450 | A * | 6/1992 | Chiu | 261/142 |
| 5,290,487 | A | 3/1994 | Ludwig | |
| 5,378,355 | A | 1/1995 | Winkler | |
| 5,587,114 | A | 12/1996 | Tharp | |
| 5,846,412 | A | 12/1998 | Tharp | |
| 6,086,056 | A | 7/2000 | Leask et al. | |
| 6,485,229 | B1 * | 11/2002 | Gunderson et al. | 405/63 |
| 6,514,886 | B1 | 2/2003 | U'Ren | |
| 6,702,263 | B2 | 3/2004 | Kelly | |
| 7,267,766 | B2 * | 9/2007 | Campion et al. | 210/221.2 |
| 2008/0224337 | A1 * | 9/2008 | Tharp | 261/120 |

FOREIGN PATENT DOCUMENTS

| | | |
|---|---|---|
| CA | 2313135 | 12/2001 |

* cited by examiner

*Primary Examiner* — Scott Bushey
(74) *Attorney, Agent, or Firm* — Husch Blackwell LLP

(57) ABSTRACT

A diffuser module and system for diffusing gas into liquid such as in aeration/mixing of wastewater. Each module has a header pipe and diffusers which receive gas from the header pipe. Each pipe is equipped with a smaller internal pipe arranged concentrically to provide an annular space which receives the gas and supplies it to the diffusers. The volume within the internal pipe can serve as a ballast chamber or a buoyancy chamber or both.

15 Claims, 3 Drawing Sheets

RETRIEVABLE DIFFUSER MODULE WITH INTERNAL BALLAST/BUOYANCY CHAMBER

CROSS-REFERENCE TO RELATED APPLICATIONS

None.

FIELD OF THE INVENTION

This invention relates generally to the application of gas to liquid and deals more particularly with a gas diffuser module which may be equipped with concentric pipes providing an annular space for supplying gas to diffusers and a chamber within the inside pipe which can serve as an internal ballast chamber or a buoyancy chamber or both.

BACKGROUND OF THE INVENTION

Applications involving the diffusion of gas into liquid include the aeration/mixing of water and wastewater in basins, lagoons, ponds and other containment structures. In the aeration/mixing of wastewater, multiple diffuser modules have been used with considerable success. A typical system includes floating or submerged air laterals which receive air from a blower or fan and apply the air through flexible air lines extending to submerged diffuser modules. The diffuser modules may be of various types, one of which is a construction having a header pipe supporting elongated diffuser pipes that extend from its opposite sides. The diffusers may be flexible membrane tube diffusers having flexible membranes sleeved over the diffuser pipes, flexible membrane disk diffusers mounted on the diffuser pipes, or any other suitable type of diffuser. The modules may be arranged in a grid pattern throughout the basin to provide thorough and uniform mixing/aeration of the waste water.

Although systems using diffuser modules of this type have been successful, they are not wholly without problems. Maintenance and repair of the diffusers can be particularly difficult because of their submerged location. The diffusers must either be maintained or repaired in place, or, more commonly, the entire module containing one or more worn or defective diffusers must be lifted to the surface using a large crane or other heavy equipment. In large installations, it may be difficult if not impossible for a crane to reach units in the center or near a remote side or end of the basin, even if the crane is equipped with a lengthy boom. The need for heavy ballast to hold the modules down in normal operation adds to the difficulty involved in raising and maintaining the modules.

After maintenance and repair operations have been completed, the module must be replaced in the basins, again requiring the use of a crane or other heavy equipment and again complicated by the heavy ballast. Replacing the module involves the risk of damage, particularly if the module is tilted appreciably or is otherwise handled improperly as it is being lowered in the basin. If one or more of the diffusers are damaged during replacement, additional repair work is necessary and additional downtime of the entire system may result.

SUMMARY OF THE INVENTION

The present invention is, in one aspect, directed to a method and apparatus which facilitates retrieval of diffuser modules through the provision of a pipe inside a pipe construction that presents an annular space between the pipes for supplying gas to the diffusers along with a chamber inside the internal pipe which can serve as an internal ballast chamber or a buoyancy chamber or both.

This aspect of the invention involves the provision of a multiple diffuser module equipped with a main header pipe and a smaller internal pipe creating an annular space which supplies gas to the diffusers. The volume within the internal pipe provides a chamber that is sealed from the annular space and may be supplied with gas to effect a buoyant condition causing the module to rise to the surface, or purged of gas to effect a nonbuoyant condition causing the module to descend to its submerged operating position for diffusing gas into the liquid.

Another aspect of the invention involves maintaining gas continually in the chamber within the internal pipe to make the diffuser module continually buoyant, with the module normally being held down in a submerged operating position but being releasable so that the buoyancy causes the module to rise to the surface for access to the diffusers for repair, maintenance or other purposes.

The diffuser modules may be suspended from floating air laterals or may be floor mounted units. The air supply may be provided from virtually any convenient location. Various types of diffusers may be used on the module. Of particular benefit when the chamber in the internal pipe is used as a ballast chamber is the ability to minimize the need for additional ballast. This facilitates retrieval of the diffuser modules as well as handling and placement of the modules back in the basin or lagoon. Also, because the header pipe is not supplied with heavy ballast, the header pipe can be constructed of plastic rather than metal, and advantage may be taken of the benefits of plastic, including reduced cost.

BRIEF DESCRIPTION OF THE SEVERAL VIEWS OF THE DRAWING

In the accompanying drawings, which form a part of the specification and are to be read in conjunction therewith and in which like reference numerals are used to indicate like or similar parts in the various views.

DETAILED DESCRIPTION OF THE INVENTION

Figure 1:
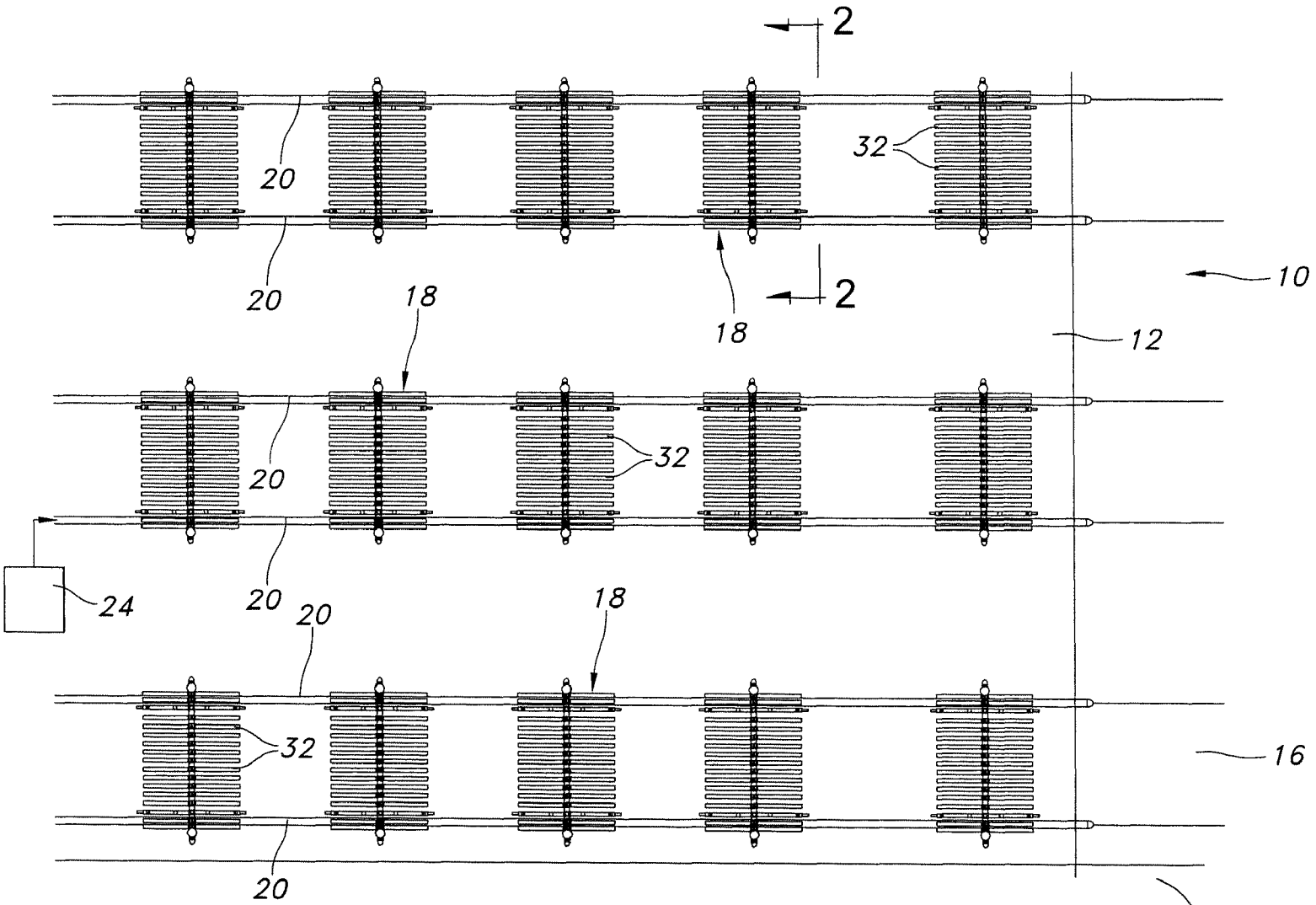
FIG. 1 is a top plan view diagrammatically illustrating a wastewater aeration/mixing system equipped with a plurality of retrievable diffuser modules constructed according to one embodiment of the present invention.
Figure 2:
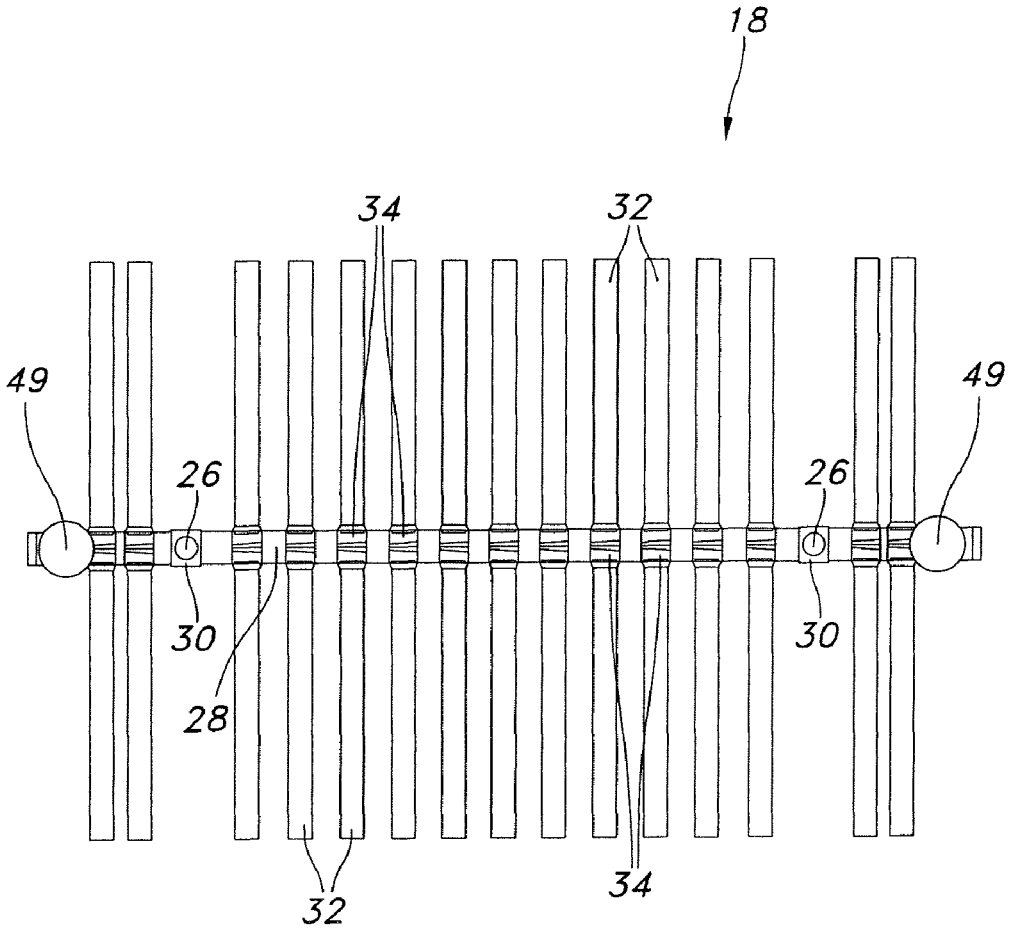
FIG. 2 is a top plan view on an enlarged scale of one of the diffuser modules in the system of FIG. 1.
Figure 3:
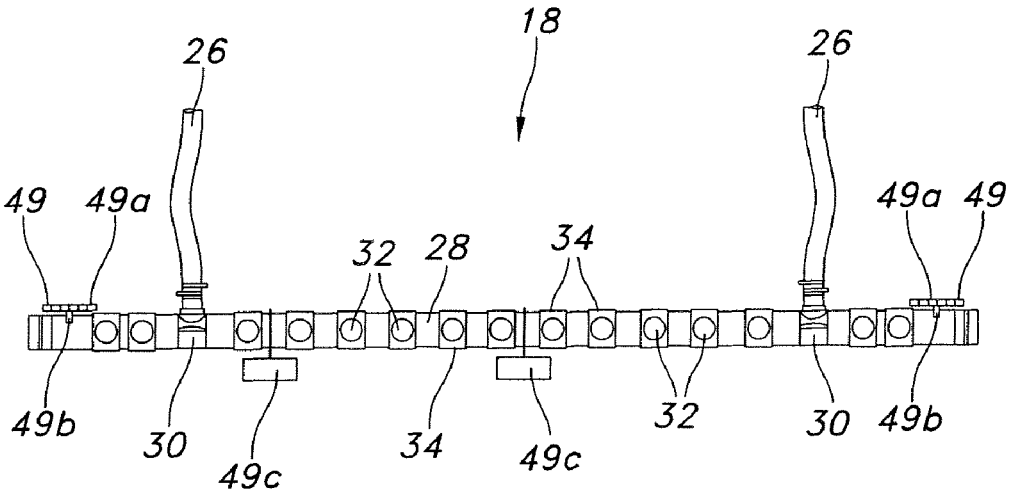
FIG. 3 is a fragmentary elevational view on an enlarged scale taken generally along line 3-3 of FIG. 1 in the direction of the arrows.

Referring now to the drawings in more detail and initially to FIGS. 1-3, the present invention is directed to the application of gas to a liquid which may take the form of an aeration/mixing system generally identified by numeral 10 in FIG. 1. The system 10 may be used for the aeration/mixing of wastewater contained in a basin having a floor 12 bounded by sloping opposite sidewalls 14 and sloping opposite end walls 16. Alternatively, the system 10 can be used in basins, tanks, lagoons, ponds or other containers having virtually any size and configuration.

The system 10 includes a plurality of diffuser modules generally identified by numeral 18. The diffuser modules 18 may be supplied with air from a plurality of floating supply pipes or air laterals 20 which may be plastic pipes floating on the surface of the wastewater (see FIG. 1). Air is supplied to the floating air laterals 20 by a blower 24 (FIG. 1) or other suitable source of air. Flexible air hoses 26 are connected at their upper ends with the air laterals 20 and at their lower ends with the diffuser modules 18 in order to deliver air from the air laterals 20 to the diffuser modules 18. A variety of other air supply arrangements can be employed, including a header pipe on a wall of a basin connected to flexible hoses feeding air to the diffuser modules 18.

One construction of the air modules 18 is best shown in FIGS. 2 and 3. Each module 18 has a frame which includes a central header pipe 28 extending the length of the module 18 along its longitudinal axis. The pipe 28 may be constructed of any suitable material, including stainless steel, plastic or the various other types of materials used in such applications. Plastic is preferred, principally for cost reasons and because the module construction does not require the strength of metal. Near the opposite ends of each header pipe 28, saddle fittings 30 (or other types of fittings such as hose insert fittings) provide connections between the lower ends of the flexible air hoses 26 and the pipe 28. In this manner, air is supplied through the hoses 26 to the header pipe 28 and along the length of each header pipe. A plurality of diffuser pipes 32 extend from the opposite sides of the header pipe 28 and may be arranged in groups spaced apart along the length of the header pipe 28. The diffuser pipes 32 may be connected with the header pipe 28 by saddles 34 or in any other suitable manner. The saddles 34 provide entry points admitting air to the diffuser pipes 32 from the header pipes 28. The diffuser pipes 32 are preferably equal in length and are oriented horizontally when the aeration module 18 is submerged in the treatment basin in its operating position.

The diffuser pipes 32 may be equipped with conventional flexible membranes sleeved over the pipes in order to diffuse air into the wastewater from the pipes 32 in the form of fine bubbles for high efficiency aeration. Alternatively, disk diffusers (not shown) may be mounted along the length of each diffuser pipe 32 and equipped with disk membranes which apply the air through the membranes in the form of fine bubbles. Other types of diffusers may be used as well.

Figure 6:
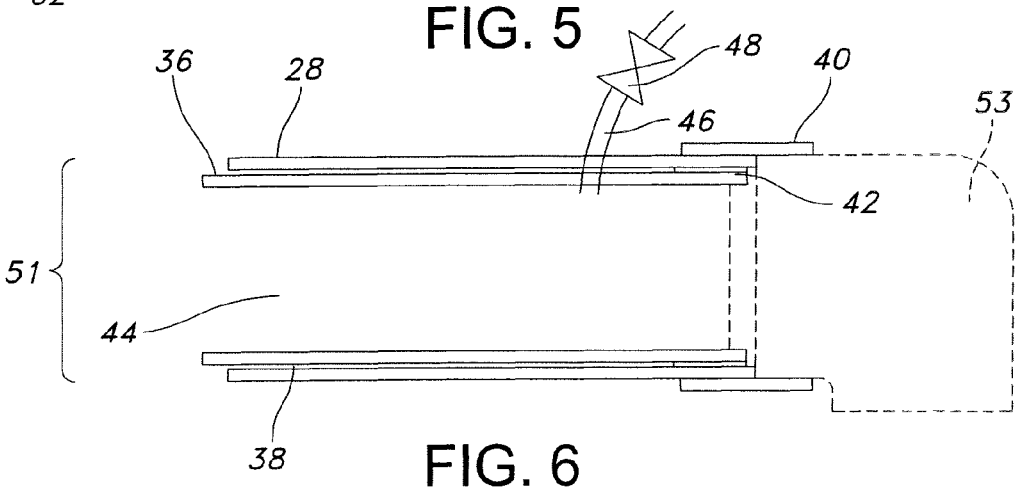
FIG. 6 is a fragmentary view on an enlarged scale showing the details of how the header pipe may be sealed to the internal pipe of each diffuser module to provide an internal ballast/buoyancy chamber.

To provide an internal ballast/buoyancy chamber, each header pipe 28 contains within it a smaller internal pipe 36 (FIG. 6) which extends concentrically within pipe 28 its entire length or part of its length. As shown in FIG. 6, pipe 36 has a smaller diameter than pipe 28 such that an annular space 38 is provided between the outside surface of pipe 36 and the inside surface of pipe 28. The space 38 may have any desired width and extends the length of the pipes 28 and 36.

With continued reference to FIG. 6 in particular, each end of each pipe 28 is equipped with a special fitting 40 which includes a seal ring 42. The seal rings 42 seal the opposite ends of the annular space 38. The saddles 30 open into space 38, so the gas is supplied to space 38 and is transmitted along the length of space 38 and to the diffuser pipes 32 for diffusion into the wastewater or other liquid.

The volume within each internal pipe 36 provides a cylindrical chamber 44 which may serve as a ballast chamber, a buoyancy chamber or both when properly configured, as will be described in more detail. A buoyancy line 46 equipped with a valve 48 may extend to connection with each chamber 44. The valve 48 may be a three-way device having a closed position to close off flow through line 46, an open position allowing air from blower 24 or another source to be applied through line 46 to chamber 44, and a vent position wherein air in chamber 44 is vented to the atmosphere.

As best shown in FIG. 6, one end of the internal pipe 36 may be capped by a suitable end cap 51. The other end of pipe 36 may be equipped with a down-turned elbow 53 having an open lower end at a lower elevation than pipe 36. The elbow 53 acts as a hydraulic valve for purging liquid from pipe 36 when gas is applied, and allowing liquid to enter pipe 36 when gas is vented from pipe 36. The liquid in pipe 36 then acts as ballast. The cap 51 may be eliminated and replaced by a down-turned elbow such as elbow 53 to provide a hydraulic valve on each end of the module.

A pair of purge units 49 are provided on the header pipe 28 near its opposite ends. Each purge unit 49 may include a small disk diffuser 49*a* having a dip tube 49*b* extending from the diffuser into the annular space 38. Any condensate or water that may be present in space 38 is purged through the dip tube 49*b* and diffuser 49*a* when air is forced into space 38 during normal operation. The purge units 49 may be located as desired but are preferably on the bottom of pipe 28 so that the water is purged through the lowest point of the annular space 38.

The aeration system 10 is installed with the diffuser modules 18 at a submerged location in the treatment basin which may be at or near the floor 12. The modules are preferably dispersed throughout the treatment basin in a grid pattern such as shown in FIG. 1.

Air supplied by the blower 24 is delivered to the air laterals 20 and downwardly through the air hoses 26 to the annular space 38. The space 38 in turn delivers the air to the diffuser pipes 32 from which the air is diffused in the form of fine bubbles into the wastewater for aeration/mixing of the wastewater. The wastewater or other liquid fills each chamber 44 and serves as ballast which holds the diffuser modules down in the basin or lagoon during operation. In this way, the chambers 44 may function as ballast chambers. Additional ballast such as ballast blocks 49*c* strapped (or otherwise attached) to the header pipes 28 may also be supplied, but the ballast blocks 49*c*, if necessary at all, are much lighter than would be required in the absence of the use of chambers 44 as ballast chambers containing water.

In the event that maintenance, repair, replacement, or other work on one or more of the diffusers is required, the module 18 containing the diffuser that is to be maintained may be retrieved to the surface for access to the diffuser. Air or another gas under pressure may be supplied through the valves 48 to lines 46 and into the chambers 44. The gas displaces the liquid in chambers 44 by forcing the liquid out through elbow 53 and causes each diffuser module 18 to assume a buoyant condition. The buoyancy causes the modules to rise to the surface of the liquid where the diffuser pipes 32 are accessible for inspection, maintenance, repair or replacement.

After the maintenance work has been completed, the module 18 can be restored to its submerged operating position. The valves 48 are closed, and liquid fills each chamber 44 through elbow 53 to make each diffuser module non-buoyant such that it sinks to its normal operating position.

Figure 4:
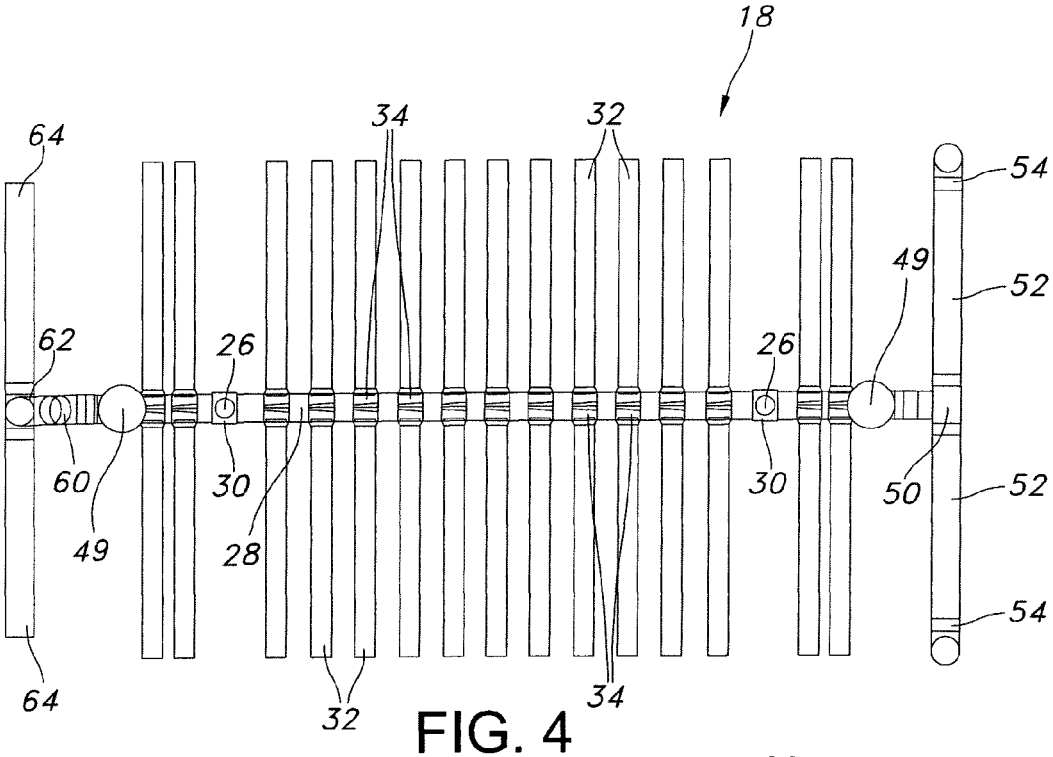
FIG. 4 is a top plan view on an enlarged scale of a modified diffuser module constructed according to another embodiment of the invention.
Figure 5:
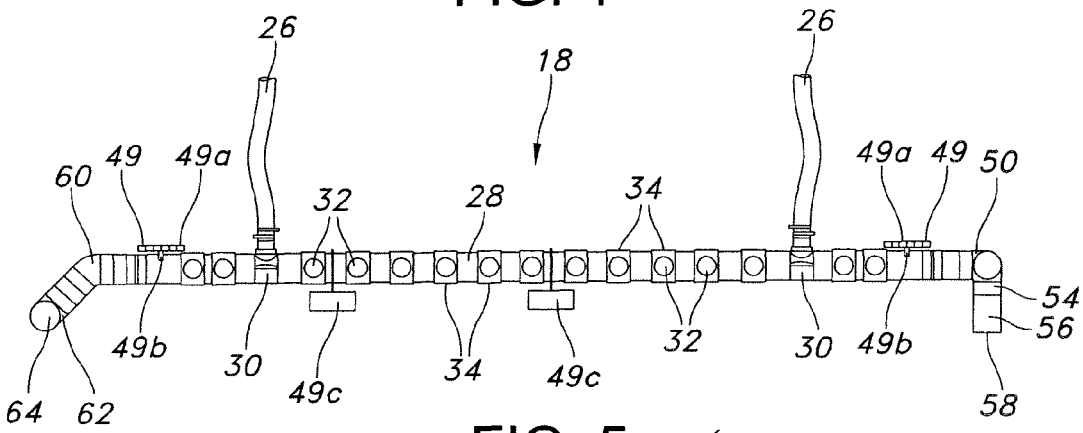
FIG. 5 is a fragmentary side elevational view of the diffuser module shown in FIG. 4.

FIGS. 4 and 5 depict a modified embodiment in which a tee fitting 50 is secured to fitting 40 which serves as a coupling for fitting 50. Horizontal pipes 52 extend in opposite directions from the fitting 50 and are equipped on their outer ends with down-turned elbows 54 and spouts 56 providing flow control openings 58 on their lower ends at a location below pipe 36. The openings 58 serve as hydraulic valves for purging liquid from pipe 36 when gas is supplied through the buoyancy lines 46 and admitting liquid to pipe 36 when chamber 44 is to serve as a ballast chamber. Alternatively, a single elbow (not shown) may be coupled using fitting 40, with the elbow having a down turned end equipped with a vertical drop leg serving as a hydraulic seal.

Alternatively or in addition, the end of each pipe 36 opposite the flow control openings 58 may be equipped with a 45° fitting 60 leading to a tee fitting 62 from which a pair of horizontal pipes 64 extends in opposite directions. The pipes 64 may have open or closed outer ends, usually open ends to assist in the hydraulic seal function.

As an alternative to the system described, the internal pipes 36 may be closed off on the ends and continually filled with gas to make the modules 18 continually buoyant. In this case, the buoyant modules can be held down by a releaseable hold-down system of any suitable type, including the type disclosed in U.S. Pat. No. 5,587,114 or in pending patent application Ser. No. 11/685,608, filed on Mar. 13, 2007 in the name of Charles E. Tharp and entitled "Diffuser Assembly With Buoyancy Vessel".

The double tube construction using the header pipe 28 and internal pie 36 has benefits in addition to the buoyancy aspects described above. Because of the presence of the large diameter header pipe 28, saddle-mounted tube diffusers of substantial length can be used, leading to higher efficiency aeration/mixing. Other types and shapes of large diffusers can also be employed. Additionally, the large diameter pipe 28 has greater structural strength than a smaller pipe and is better able to withstand the hydraulic forces encountered during operation and the forces applied to the piping during retrieval and/or replacement of the diffuser assemblies. Because large diameter piping is used, the pipes can be constructed of plastic rather than more costly steel or stainless steel, although any suitable material can be used to construct the pipes.

It is preferred that the annular space 38 be supplied by plural hoses, preferably two relatively small diameter hoses 26 located approximately one fourth of the length of pipe 28 from the opposite ends of pipe 28. The two hoses 26 can feed air efficiently in both directions, and the hoses can be relatively small for cost benefits. Small hoses are also beneficial in that they allow the diffuser assemblies to be raised and handled more conveniently during maintenance operations.

While multiple small hoses are preferred, a single large hose can be used. If a single hose is used, it preferably feeds the diffuser assemblies at a location near the center of pipe 28 so that the incoming air can move in opposite directions toward the ends of pipe 28. A hose or hoses supplying pipe 28 at one end of the pipe can be used but may possibly create an end to end imbalance in the buoyancy and require special ballast provisions. Even so, end feeding of pipe 28 may be preferable in many applications.

The presence of the openings 58 on the lower ends of spouts 56 (or a single opening in the case of a single elbow leading to a single spout) provides a hydraulic seal allowing air to enter the opposite end of pipe 36 into the buoyancy chamber 44 while forcing water out opening 58. The sealing effect of opening 58 prevents air from escaping. Also, if the air is applied at or near the end opposite opening 58, the inlet end becomes buoyant first such that the entire diffuser assembly tips to maintain opening 58 well below the inlet end. As a result, the length of the spout 56 need not be great. It is expected that a spout about one foot long will suffice in most applications, although the length can vary as necessary. The height of pipe 28 above the basin floor provides a limit on the spout length in this embodiment, but need not limit the spout if an alternative construction is used.

A significant benefit of providing a diffuser assembly that can be made buoyant is that it can be floated to the surface, disconnected from the air supply, and moved to the side of the basin or lagoon where it is readily accessible for maintenance. Following the maintenance work, the diffuser assembly can be returned to its operating position, reconnected with the air supply, and made nonbuoyant so that it sinks to its proper position for operation. Recognizing that some basins are as large as one fourth mile long or more, this makes maintenance practical without the need for a large barge with a crane for lifting the diffusers or an extremely large crane on the bank with enough reach to access diffusers that are in the center area of the basin. The result is that the present invention greatly reduces the need for costly retrieval equipment such as maintenance barges and large cranes, while making maintenance easier and more expeditious.

In some applications, especially those involving a large number of diffusers, the aeration can have a high energy level that requires a substantial weight of ballast to counteract. In such a situation, the buoyancy of chamber 44 may be insufficient to overcome the ballast and float the diffuser modules to the surface. Then, additional buoyancy can be provided in several ways, including the provision of an additional length of buoyancy piping forming an extension of pipe 36 and coupled to pipe 36 by the coupling 42, use of fitting 60 and pipes 64 for buoyancy (optionally extended by additional piping providing more volume), or use of pipes 52 plus possible additional piping for more buoyancy volume.

The invention contemplates an arrangement in which the inside pipe 36 is not alternately supplied with and relieved of gas. In this type of arrangement, pipe 36 may be filled or partially filled with gas, liquid or solid materials, or some combination thereof, and its ends may be sealed. This has the advantage of providing a relatively small gas channel (annular space 38) and thus requiring only small air supply lines, while at the same time having the structural benefits of relatively large piping. If a single pipe were used with the volume of space 38, the pipe would necessarily be small in diameter and structurally weaker than the larger pipes used in the pipe-within-a-pipe configuration.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A diffuser module for applying gas to liquid, comprising:

a frame including a header pipe and an internal pipe located within said header pipe to provide a generally annular space between said internal pipe and said header pipe;

a plurality of diffusers connected with said header pipe in a manner to receive gas from said generally annular space and discharge the gas into the liquid;

a gas line for applying the gas to said generally annular space; and said internal pipe presenting a chamber sealed from said generally annular space.

2. A diffuser module as set forth in claim 1, wherein said chamber is substantially filled with liquid to effect a nonbuoyant condition of said module.

3. A diffuser module as set forth in claim 2, including a buoyancy line connected with said chamber for applying gas thereto to substantially evacuate liquid therefrom and effect a buoyant condition of said diffuser module.

4. A diffuser module as set forth in claim 3, including at least one flow control opening through which liquid enters and is discharged from said chamber.

5. A diffuser module as set forth in claim 4, wherein said at least one flow control opening is at an elevation lower than said chamber.

6. A diffuser module as set forth in claim 1, wherein said chamber is continually full of gas to effect a buoyant condition of said module, said module normally being held down at a submerged location in the liquid but being selectively releaseable to ascend to the surface of the liquid.

7. Apparatus for applying gas to liquid, comprising:

a plurality of diffuser modules for immersion in the liquid, each module including a header pipe and an internal pipe located within said header pipe, wherein a chamber is provided within said internal pipe and an annular space is provided between said internal pipe and said header pipe;

a plurality of diffuser pipes extending from each header pipe in communication with said annular space to receive gas therefrom for discharge into the liquid; and a gas supply line for delivering gas to said annular space, said annular space being sealed from said chamber to allow said chamber to receive liquid effecting a nonbuoyant condition of each diffuser module.

8. A diffuser module as set forth in claim 7, including a buoyancy gas supply line connected with said chamber.

9. A diffuser module as set forth in claim 8, including at least one flow control opening through which liquid enters and is discharged from said chamber.

10. A diffuser module as set forth in claim 9, wherein said at least one flow control opening is at an elevation lower than said chamber to provide a hydraulic seal.

11. Apparatus for applying gas to liquid, comprising:

a plurality of diffuser modules each including a header pipe and a plurality of diffuser pipes extending from said header pipe;

an internal pipe extending within each header pipe in a generally concentric arrangement wherein a generally annular space is provided between said internal pipe and said header pipe, each internal pipe providing a buoyancy chamber receiving gas to effect a buoyant condition of each said module; and a gas supply line extending to said space to supply gas thereto for delivery from said space to said diffuser pipes to effect diffusion of the gas into the liquid.

12. Apparatus as set forth in claim 11, wherein each internal pipe is open to liquid in which it is immersed and including a seal for isolating said annular space from said buoyancy chamber of each module.

13. A method of operating a submerged diffuser assembly having a header pipe and a plurality of diffusers receiving gas from the header pipe, said method comprising:

providing an internal pipe within said header pipe in a generally concentric arrangement therewith to provide a generally annular space between said internal pipe and said header pipe;

applying gas to said space to effect application of gas to said diffusers for diffusion into the liquid; and maintaining liquid in said internal pipe to effect a nonbuoyant condition of the diffuser assembly for maintaining a submerged location thereof.

14. A method as set forth in claim 13, including the step of selectively applying gas to said internal pipe to displace the liquid and effect a buoyant condition of the diffuser assembly.

15. A method as set forth in claim 14, including the step of selectively venting gas from said internal pipe to allow entry of liquid into said internal pipe to effect the nonbuoyant condition of the diffuser assembly.

* * * * *